US011817250B2

(12) United States Patent
Takken et al.

(10) Patent No.: US 11,817,250 B2
(45) Date of Patent: Nov. 14, 2023

(54) BROADSIDE COUPLED COPLANAR INDUCTORS

(71) Applicant: International Business Machines Corporation, Armonk, NY (US)

(72) Inventors: Todd E. Takken, Brewster, NY (US); Xin Zhang, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 1118 days.

(21) Appl. No.: 16/405,071

(22) Filed: May 7, 2019

(65) Prior Publication Data

US 2020/0357563 A1 Nov. 12, 2020

(51) Int. Cl.

*H01F 5/00* (2006.01)
*H01F 27/28* (2006.01)
*H01F 41/04* (2006.01)

(52) U.S. Cl.

CPC ..... *H01F 27/2804* (2013.01); *H01F 41/041* (2013.01); *H01F 2027/2819* (2013.01)

(58) Field of Classification Search

CPC ..... H01F 27/2804
USPC ..... 336/200
See application file for complete search history.

(56) References Cited

U.S. PATENT DOCUMENTS 6,329,604 B1 * 12/2001 Koya ..... H05K 1/0219 174/262
7,652,548 B2 1/2010 Yoshikawa et al.
8,203,386 B2 6/2012 van der Heijden et al.
2007/0018767 A1 * 1/2007 Gabara ..... H01F 17/0006 336/200
2008/0309299 A1 * 12/2008 Wei ..... G05F 3/04 336/178
2013/0324044 A1 * 12/2013 Kuroda ..... H04B 5/0075 455/41.1

FOREIGN PATENT DOCUMENTS

CN 103647122 A 3/2014
CN 104934673 A 9/2015
(Continued)

OTHER PUBLICATIONS

Li, C., et al., A 21 GHz complementary transformer coupled CMOS VCO. IEEE Microwave and Wireless Components Letters, 18(4), Apr. 2008, pp. 278-280.
(Continued)

*Primary Examiner* — Ronald Hinson
(74) *Attorney, Agent, or Firm* — Scully, Scott, Murphy & Presser, PC; Daniel P. Morris, Esq.

(57) ABSTRACT

A broadside coupled coplanar inductor device includes first and second coplanar inductors in which the conductors of the first and second coplanar inductors are broadside coupled. The conductors are located one above the other at a first distance and the return paths are located to the side of the respective first and second conductor signal paths at a second distance. One or both of the dimensions of the first and second first distances is defined so as to maximize a mutual inductance between the conductors. First and second driver circuit apply voltages across each conductor. The input pulse width modulation signals applied to the first and second driver circuits are 180 degrees out of phase.

16 Claims, 6 Drawing Sheets

(56) References Cited

FOREIGN PATENT DOCUMENTS

| | | | |
|---|---|---|---|
| CN | 105006621 | A | 10/2015 |
| CN | 108039546 | A | 5/2018 |
| WO | 2000045170 | | 8/2000 |

OTHER PUBLICATIONS

Vegesna, S., & Saed, M. A., Compact two-layer microstrip bandpass filters using broadside-coupled resonators. Progress in Electromagnetics Research, 37, 2012, pp. 81-102.

* cited by examiner

BROADSIDE COUPLED COPLANAR INDUCTORS

This invention was made with Government support under Contract No.: B621073 awarded by the Department of Energy. The Government has certain rights in this invention.

BACKGROUND OF THE INVENTION

This disclosure is directed to inductors and more particularly, broadside coupled coplanar inductors.

Inductors are widely used in power converter applications. Applications may include power supplies provided on a P10 motherboard, for example. However, it is difficult to get high inductance with small volume that is required for these applications. Broadside coupling has been used in microwave filters, microwave couplers and planar transmission line designs. However, magnetic coupling principles have not been applied to inductors formed from layered structures.

SUMMARY OF THE INVENTION

A broadside coupled coplanar inductor device in one embodiment of the present invention includes a first coplanar inductor having a planar conductor signal path and a planar return path and a second coplanar inductor having a planar conductor signal path and a planar return path, wherein the conductor signal paths of the first and second coplanar inductors are broadside coupled. In one embodiment, the conductor signal paths of the first and second broadside coupled coplanar inductors are located one above the other at a first distance. In one alternative, the return paths of the first and second broadside coupled coplanar inductors are located to the side of the respective first and second conductor signal paths at a second distance. In one embodiment, one or both of the dimensions of the and second first distances is defined so as to maximize a mutual inductance between the conductor signal paths of the first and second broadside coupled coplanar inductors.

In one embodiment, the broadside coupled coplanar inductor device further includes a first driver circuit for applying a first voltage across conductor signal path of the first coplanar inductor and a second driver circuit for applying a second voltage across conductor signal path of the second coplanar inductor, wherein input pulse width modulation signals applied to the first and second driver circuits are 180 degrees out of phase. In one alternative, the first voltage applied by the first driver circuit has a first polarity and the second voltage applied by the second driver circuit has a second polarity, wherein the first and second polarities creates currents through the first and second inductors such that the currents have a relative polarity that results in a positive mutual inductance between the conductor signal paths of the first and second broadside coupled coplanar inductors that adds to a self inductance of each of the conductor signal paths of the first and second inductors.

Methods of forming the embodiments of a broadside coupled coplanar inductor device in accordance with the present invention are also disclosed.

DETAILED DESCRIPTION OF PREFERRED EMBODIMENTS

In one embodiment the present invention is directed to an inductor device utilizing broadside coupling of coplanar inductors. In broadside coupling, the conductors are one on top of the other, separated by dielectric material. The coupling is broadside because the principal surfaces of the planar conductors face each other. Coupling of magnetic fields occurs when inductors are close enough together so that the magnetic field generated by one inductor is overlapping with the magnetic field generated by the other. The distance between the conductors is a critical factor in determining the coupling. The coupling coefficient k is a measure of the extent of the inductance coupling. Broadside coupling is used to create densely packaged, highly coupled inductors. In this specification, highly coupled means k is close to the maximum value 1.

In one alternative, the inductors are driven in a way where the mutual coupling substantially enhances the effective inductance per unit volume. This may result in big inductance with small space without magnetic material. This allows making more compact power converters with less need for high magnetic permeability materials. As a result, compact inductor devices, such as power converters, using standard silicon processes, may become more practical. In one alternative, the additional separate inductance of this design is also used as separate phases, which may reduce the net output ripple current of the power converter.

Figure 1A:
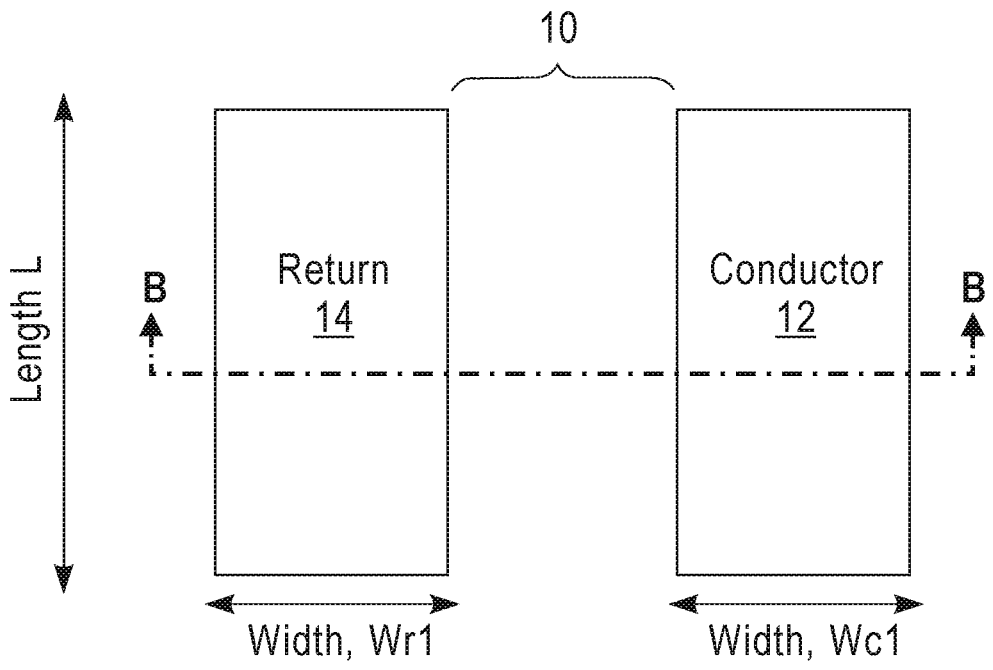
FIG. 1A is a top view of a conventional coplanar inductor device.
Figure 1B:
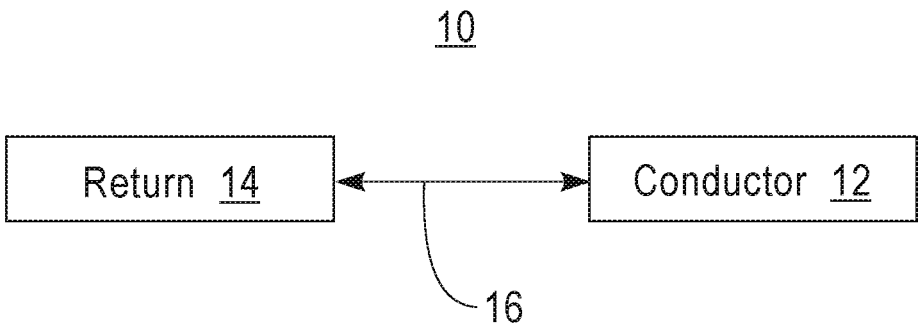
FIG. 1B is a cross-sectional view taken along lines B-B of FIG. 1A, of a conventional coplanar inductor.

FIG. 1A is a top view and FIG. 1B is a cross-sectional view taken along lines B-B of FIG. 1A, of a conventional coplanar inductor 10. The inductor 10 includes a conductor 12 that provides an inductor signal path and a return path 14, both having the same length L. Conductor 12 has width Wc1 and return 14 has width Wr1. Width Wc1 and Wr1 may be the same or different. It will be understood by those skilled in the art that the inductor device 10 is formed using standard multilayer silicon processes. As seen in the cross-sectional view, conductor 12 and return 14 are in the same horizontal plane of the multilayer structure and are separated by distance 16 in that plane.

Figure 2A:
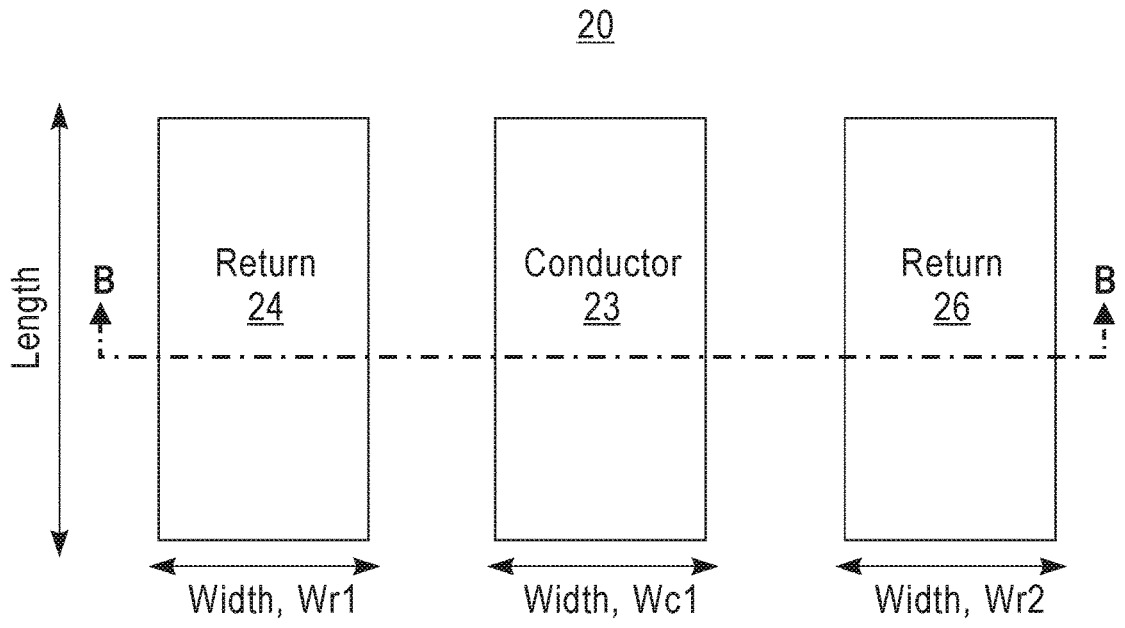
FIG. 2A is a top view of a broadside coupled coplanar inductor device in accordance with one embodiment of the present invention.
Figure 2B:
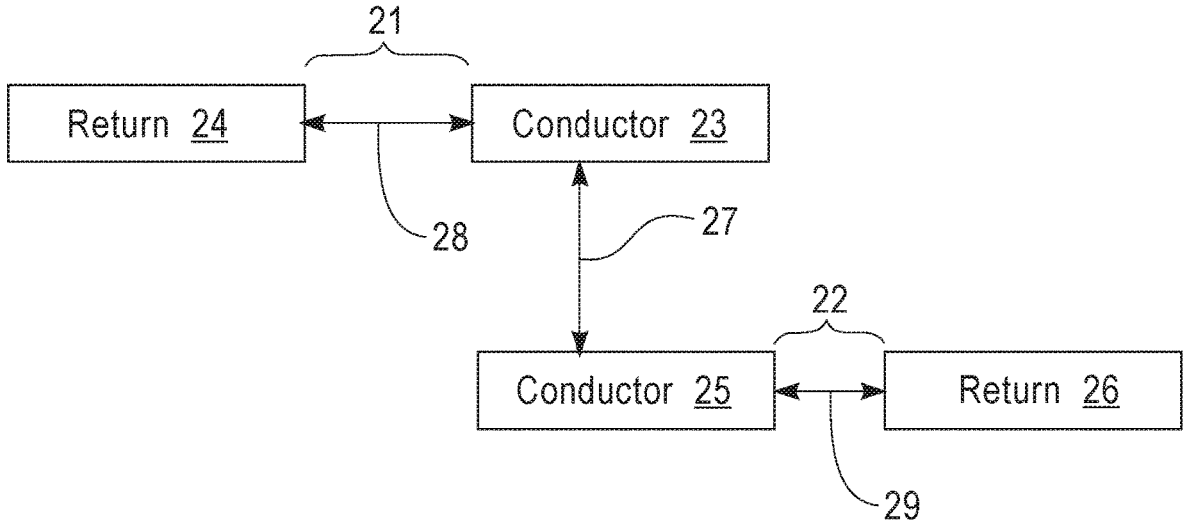
FIG. 2B is a cross-sectional view taken along lines B-B of FIG. 2A, of a broadside coupled coplanar inductor device in accordance with one embodiment of the present invention.

FIG. 2A is a top view and FIG. 2B is a cross-sectional view taken along lines B-B of FIG. 2A, of an inductor device 20 in accordance with one embodiment of the present invention. The inductor device 20 includes two broadside coupled coplanar inductors 21 and 22. Coplanar inductor 21 includes a conductor 23 that provides an inductor signal path and a return path 24. Coplanar inductor 22 includes a conductor 25 that provides an inductor signal path and a return path 26. The conductors 23 and 25 of the broadside coupled coplanar inductors 21 and 22 are broadside coupled. The conductor 23 is located above conductor 25.

In one embodiment, the broadside coupled coplanar inductors 21 and 22 are located in different metal layers of a multi-layered structure. In one alternative, both of the broadside coupled coplanar inductors 21 and 22 are each formed in a single layer of metal. In another alternative, one or both of the broadside coupled coplanar inductors 21 and 22 are formed from multiple layers of metal.

The conductors 23 and 25 are separated by a distance 27. In one embodiment, the distance 27 is formed of the dielectric material thickness between two adjacent metal layers forming conductors 23 and 25. In one embodiment, the return path 24 of broadside coupled coplanar inductor 21 is spaced at a distance 28 from conductor 23 in a same layer of the multi-layer structure. In one embodiment, the return path 26 of broadside coupled coplanar inductor 22 is spaced at a distance 29 from conductor 25 in a same layer of the multi-layer structure.

In one embodiment, the dimension of the distance 27 is defined so as to maximize the mutual inductance between the inductor signal paths. For example, in one embodiment, the inductor device 20 is formed in a manner to minimize distance 27 in order to achieve maximum mutual inductance. The actual distance 27 may depend on the integrated circuit fabrication process or PCB fabrication process. In one embodiment, the distances 28 and 29 are defined so as to determine the self inductance of the conductor signal paths of the first and second broadside coupled coplanar inductors.

Figure 3:
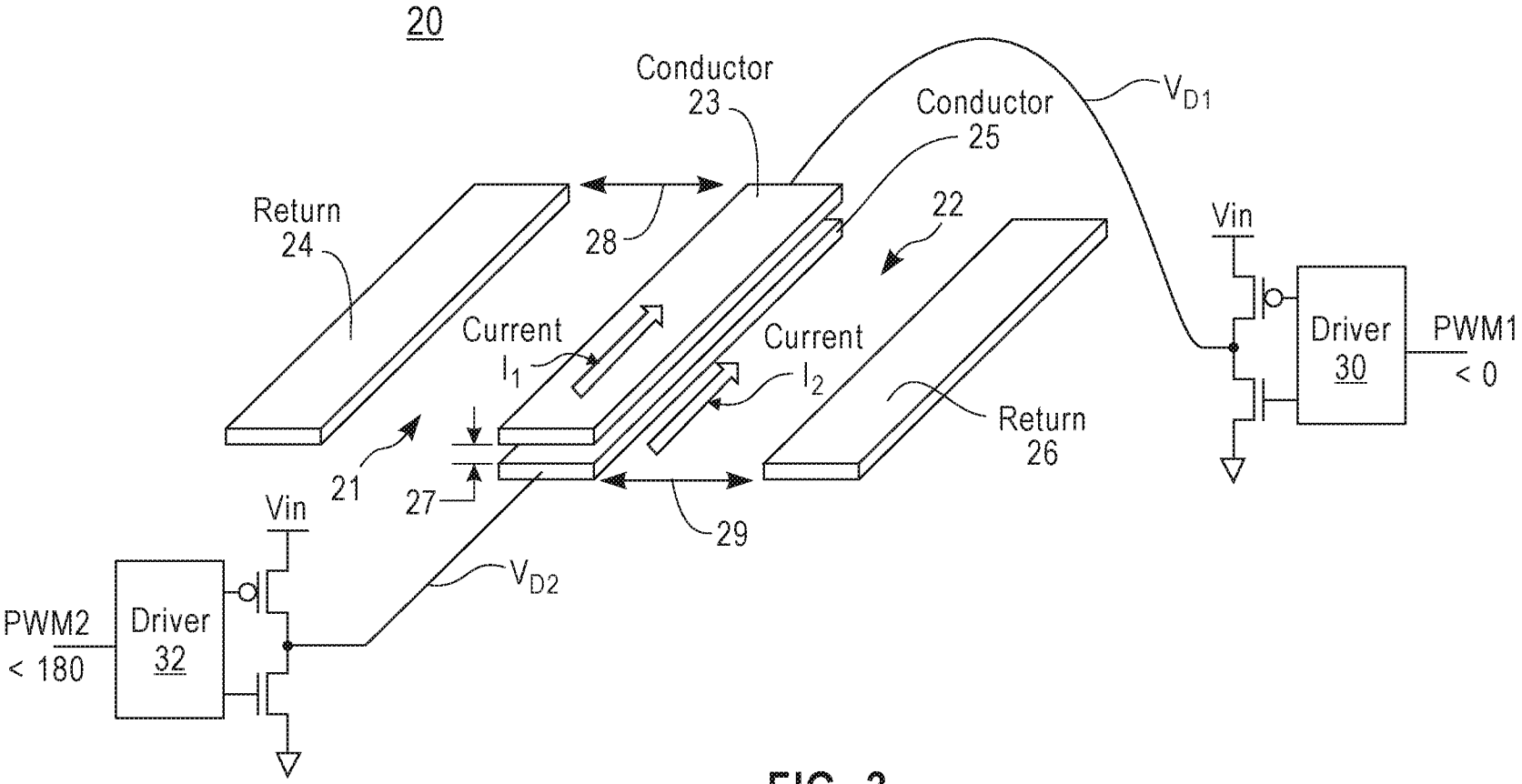
FIG. 3 is a schematic diagram of one embodiment of the inductor device including a broadside coupled coplanar inductor device in accordance with one embodiment of the present invention.

FIG. 3 is a schematic diagram of one embodiment of the inductor device 20. The inductor device 20 includes driver circuit 30 for driving conductor 23 of inductor 21 and driver circuit 32 for driving conductor 25 of inductor 22. The driving circuits 30 and 32 are identical but the input pulse width modulation (PWM) signals are 180 degrees out of phase. Driving circuit 30 produces a voltage $V_{D1}$ of a first polarity across conductor 23 which creates current $I_1$ across conductor 23. Driving circuit 32 produces a voltage $V_{D2}$ of a second polarity across conductor 25 which creates current $I_2$ across conductor 25.

Voltage $V_1$ induced across conductor 23 is:

$$V_1 = L_1 \frac{dI_1}{dt} + M \frac{dI_2}{dt}$$

Voltage $V_2$ induced across conductor 25 is:

$$V_2 = L_2 \frac{dI_2}{dt} + M \frac{dI_1}{dt}$$

$L_1$ is the inductance of conductor 23 and $L_2$ is the inductance of conductor 25.

The mutual inductance M is:

$$M = k\sqrt{L_1 \cdot L_2}$$

The coupling coefficient k is: $0 \leq k < 1$

In one embodiment, the polarity of the driver circuits 30 and 32 driving the two broadside coupled coplanar inductors 21 and 22 creates currents though the conductors 23 and 25, such that the currents have a relative polarity. The polarity of the circuits in FIG. 3 is depicted by the degrees of phase, i.e., PWM1 0 degree, PWM2 180 degrees, meaning the signals PWM1 and PWM2 have a 180 degrees phase shift between them. Relative polarity of the PWM signals results in the current directions. The relative polarity results in a positive mutual inductance. This positive mutual inductance adds to the self inductances of the individual inductors. The relative polarity drives the inductors 21 and 22 in a way where the mutual coupling substantially enhances the effective inductance per unit volume.

In one embodiment, the self inductances $L_1$ and $L_2$ of the two coplanar inductors 21 and 22 are substantially the same. In one embodiment, the voltages $V_{D1}$ and $V_{D2}$ of the driving circuits 30 and 32 are substantially the same. In one embodiment, the induced currents $I_1$ and $I_2$ through conductors 23 and 25 are substantially equal.

Figure 4:
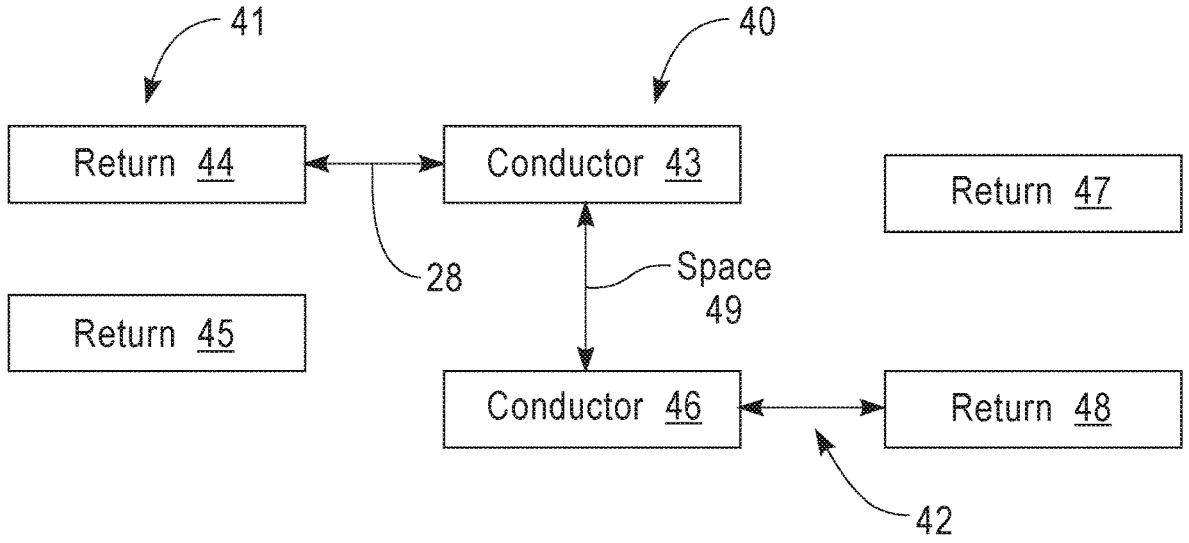
FIG. 4 is a cross-sectional view of a broadside coupled coplanar inductor device in accordance with one embodiment of the present invention.

In one embodiment, as shown in FIG. 4, a cross-sectional view of inductor device 40 includes broadside coupled coplanar inductors 41 and 42. Inductor 41 includes conductor 43 and two returns 44 and 45. Inductor 42 includes conductor 46 and two returns 47 and 48. The extra return can help contain the magnetic flux within a defined space resulting in a well defined inductance. Conductors 43 and 46 are broadside coupled. In one embodiment, return pairs 44/45 and 47/48 are arranged coplanar. In one embodiment, the space 49 is sufficiently small to allow both inductors 41 and 42 to be formed in a single layer of metal. In one alternative, inductors 41 and 42 are formed in separate layers of metal.

Figure 5:
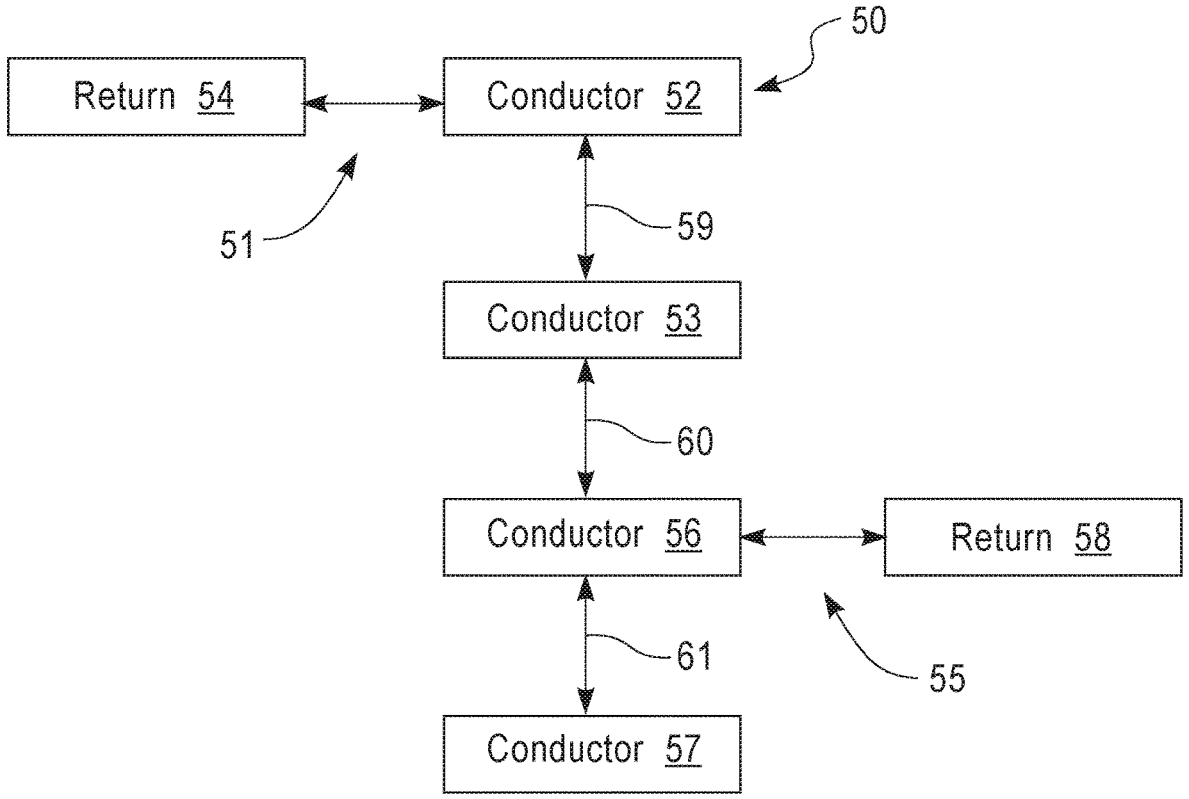
FIG. 5 is a cross-sectional view of a broadside coupled coplanar inductor device in accordance with one embodiment of the present invention.

In one alternative, the conductors of the broadside coupled coplanar inductors are formed from multiple layers of metal. As shown in FIG. 5, inductor device 50 includes inductor 51 formed of conductor portions 52 and 53 in two layers of metal and return 54 formed to the side of conductor portion 52 in the same layer of metal. Inductor 55 is formed of conductor portions 56 and 57 in two layers of metal and return 58 formed to the side of conductor portion 56 in the same layer of metal. Appropriate interlayer interconnects are provided to connect conductor portions 52 and 53 to form a single conductor and to connect conductor portions 56 and 57 to form a single conductor. Spaces 59, 60 and 61 separate the conductor portions. In one alternative, inductor 51 is formed in one layer of metal and inductor 55 is formed in a second layer of metal.

Figure 6:
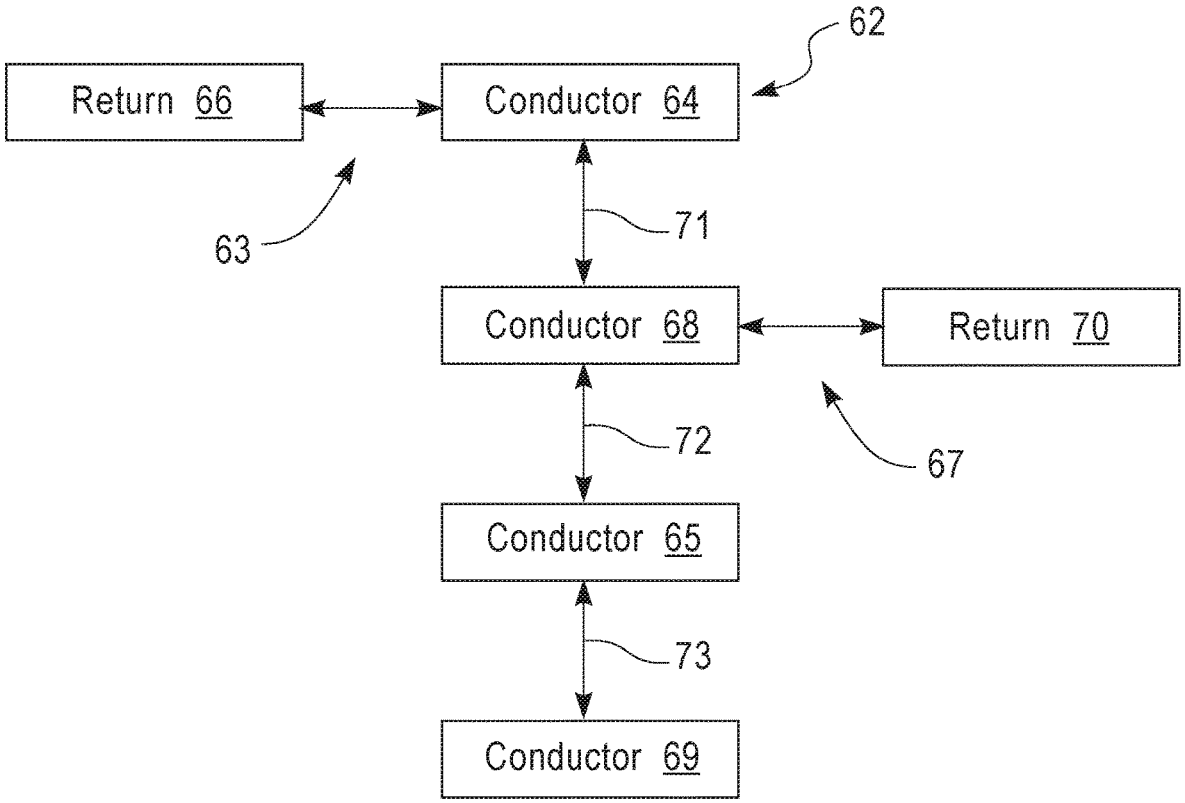
FIG. 6 is a cross-sectional view of a broadside coupled coplanar inductor device in accordance with one embodiment of the present invention.

In one embodiment, the two broadside coupled coplanar inductors are formed with the conductor portions interleaved in multiple layers of metal. As shown in FIG. 6, inductor device 62 includes inductor 63 formed of conductor portions 64 and 65 in two layers of metal and return 66 formed to the side of conductor portion 64 in the same layer of metal. Inductor 67 is formed of conductor portions 68 and 69 in two layers of metal and return 70 formed to the side of conductor portion 68 in the same layer of metal. Appropriate interlayer interconnects are provide to connect conductor portions 64 and 65 to form a single conductor and to connect conductor portions 68 and 69 to form a single conductor. Spaces 71, 72 and 73 separate the conductor portions. As shown, the conductor portions 64, 68, 65 and 69 are interleaved in multiple layers of metal. Interleaving the conductor portions may provide better coupling between the inductors.

Figure 7:
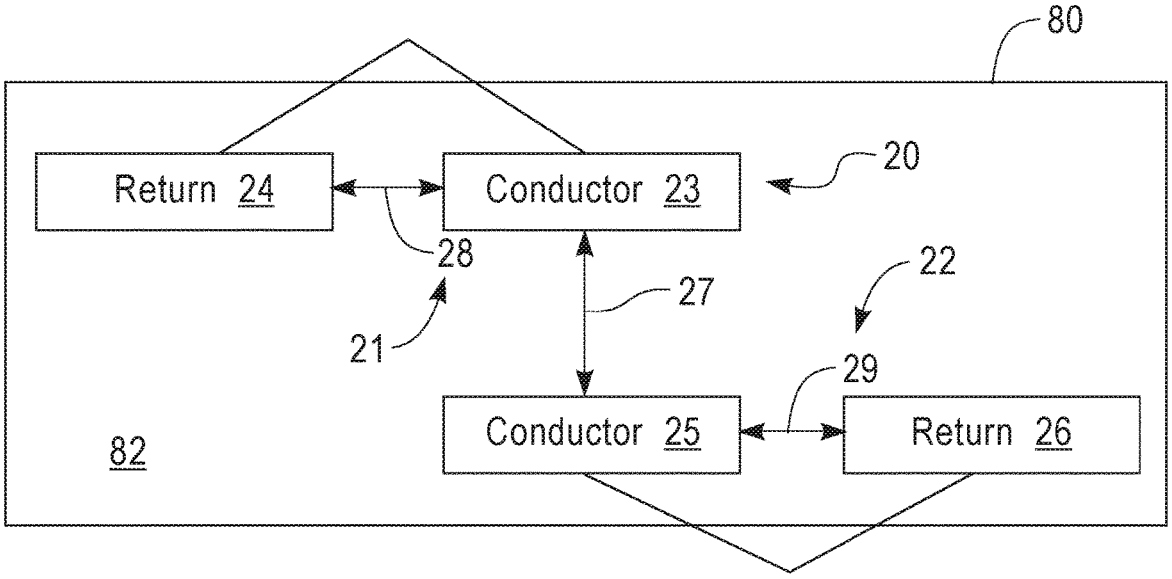
FIG. 7 is a cross-sectional view of a broadside coupled coplanar inductor device formed in a multilayer structure in accordance with one embodiment of the present invention.

In one embodiment, the inductors may be formed from wiring layers of a multilayer electronic device structure. FIG. 7 is a cross-sectional view of a multilayer structure 80 which can be, for example, a printed circuit board or an integrated circuit. In one embodiment, multilayer structure 80 includes dielectric material 82 such a FR4. The inductors 21 and 22 may be formed in one or more metal wiring layers within the structure 80. In one alternative, dielectric material 82 may be a spin-on dielectric. The inductors 21 and 22 are formed in one or more metal wiring layers within the structure 80 in a back end of line wiring process.

Figure 8:
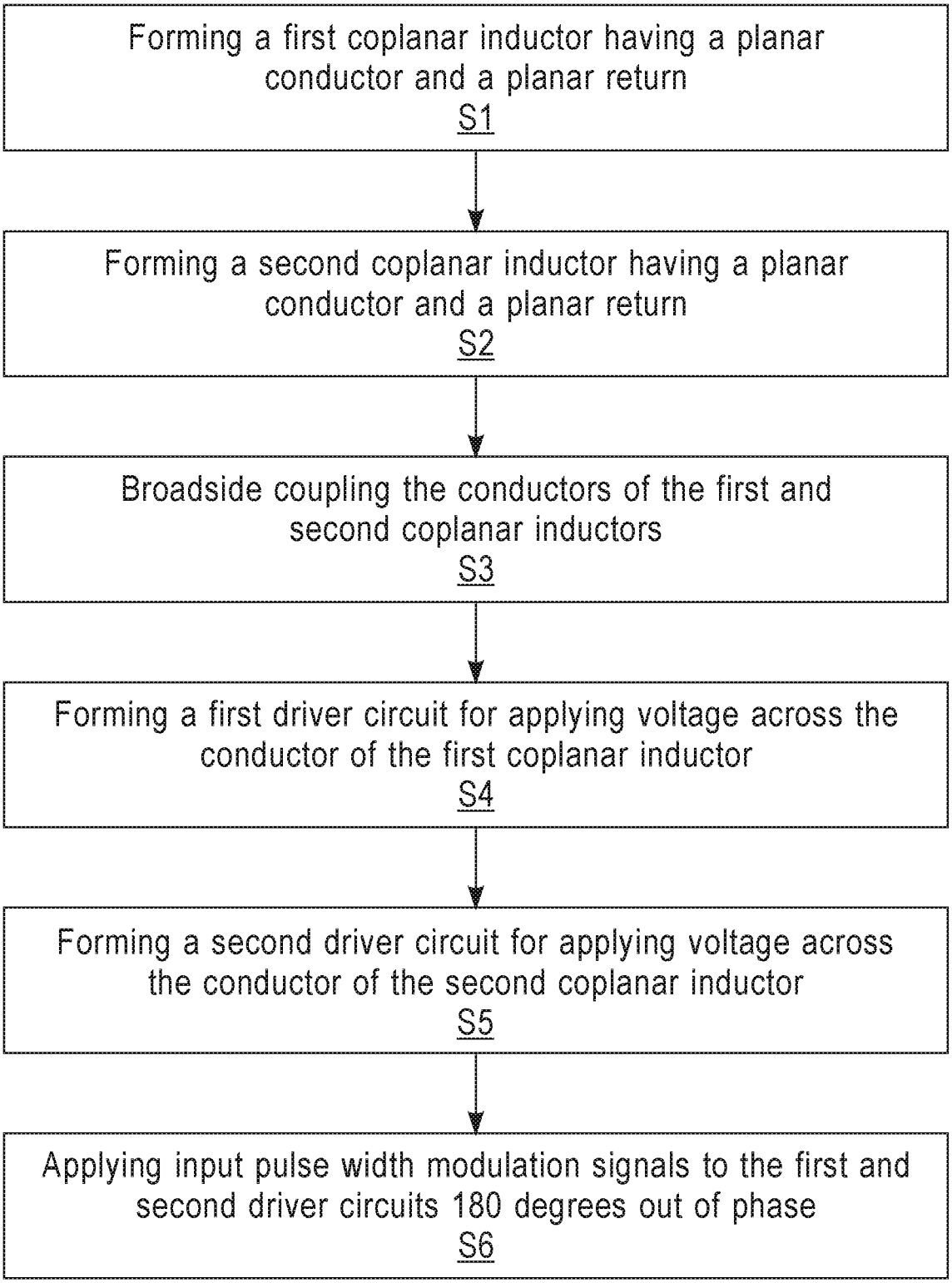
FIG. 8 is a flow chart of one embodiment of a method of forming a broadside coupled coplanar inductor device in accordance with the present invention.

FIG. 8 is flow chart showing the steps of one embodiment of a method of forming a broadside coupled coplanar inductor. The method includes step S1 of forming a first coplanar inductor having a planar conductor signal path and a planar return path and step S2 of forming a second coplanar inductor having a planar conductor signal path and a planar return path. In step S3, the conductor signal paths of the first and second coplanar inductors are broadside coupled.

In one embodiment, steps S1 and S2 includes forming the conductor signal paths of the first and second broadside coupled coplanar inductors one above the other at a first distance and forming the return paths of the first and second broadside coupled coplanar inductors to the side of the respective first and second conductor signal paths at a second distance.

In one embodiment, steps S1 and S2 include forming each of the first and second broadside coupled coplanar inductors is formed in a single layer of metal. In one alternative, steps S1 and S2 include forming at least one of the first and second broadside coupled coplanar inductors is formed in multiple layers of metal.

In one embodiment, steps S1 and S2 include forming the first and second broadside coupled coplanar inductors in interleaved metal layers.

The method of forming a broadside coupled coplanar inductor may further include step S4 of forming a first driver circuit for applying a first voltage across conductor signal path of the first coplanar inductor and step S5 of forming a second driver circuit for applying a second voltage across conductor signal path of the second coplanar inductor. Step S6 includes applying input pulse width modulation signals to the first and second driver circuits 180 degrees out of phase. In one embodiment, the input pulse width modulation signals applied to the first and second driver circuits are driven with a phase difference which maximizes the mutual inductance between the first and second inductors.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

In addition, while preferred embodiments of the present invention have been described using specific terms, such description is for illustrative purposes only, and it is to be understood that changes and variations may be made without departing from the spirit or scope of the following claims.

What is claimed is:

1. A broadside coupled coplanar inductor device comprising:

a first coplanar inductor having a first planar conductor signal path and a first planar return path spaced from the first planar conductor signal path to only a one side in a first direction; and a second coplanar inductor having a second planar conductor signal path and a second planar return path spaced from the second planar conductor signal path to only one side in a second direction, the first direction being opposite to the second direction;

wherein the first and second conductor signal paths of the first and second coplanar inductors are broadside coupled by principal surfaces of the first and second conductor signal paths directly facing each other, wherein the first and second planar return paths are not inductively coupled.

2. The broadside coupled coplanar inductor device of claim 1, wherein the conductor signal paths of the first and second broadside coupled coplanar inductors are located one above the other at a first distance.

3. The broadside coupled coplanar inductor device of claim 2, wherein the return paths of the first and second broadside coupled coplanar inductors are located to the side of the respective first and second conductor signal paths at a second distance.

4. The broadside coupled coplanar inductor device of claim 3, wherein the dimension of the first distance is defined so as to maximize a mutual inductance between the conductor signal paths of the first and second broadside coupled coplanar inductors.

5. The broadside coupled coplanar inductor device of claim 4, wherein the dimension of the second distance is defined so as to determine the self inductance of the conductor signal paths of the first and second broadside coupled coplanar inductors.

6. The broadside coupled coplanar inductor device of claim 1, wherein the first and second broadside coupled coplanar inductors have a self inductance that is substantially the same.

7. The broadside coupled coplanar inductor device of claim 1, wherein each of the first and second broadside coupled coplanar inductors is formed in a single layer of metal.

8. The broadside coupled coplanar inductor device of claim 1, wherein at least one of the first and second broadside coupled coplanar inductors is formed in multiple layers of metal.

9. The broadside coupled coplanar inductor device of claim 8, wherein the metal layers forming the first and second broadside coupled coplanar inductors are interleaved.

10. The broadside coupled coplanar inductor device of claim 1, wherein the first and second coplanar inductors each include two return paths.

11. The broadside coupled coplanar inductor device of claim 1, wherein the conductor signal paths of the first and second broadside coupled coplanar inductors are formed from wiring layers in integrated circuit back end of line wiring process.

12. The broadside coupled coplanar inductor device of claim 1, further comprising:

a first driver circuit for applying a first voltage across conductor signal path of the first coplanar inductor; and a second driver circuit for applying a second voltage across conductor signal path of the second coplanar inductor;

wherein input pulse width modulation signals applied to the first and second driver circuits are driven with a phase difference which maximizes mutual inductance between the first and second inductors.

13. The broadside coupled coplanar inductor of claim 12, wherein the phase difference between the first and second driver circuits is 180 degrees.

14. The broadside coupled coplanar inductor device of claim 12, wherein the first voltage applied by the first driver circuit has a first polarity and the second voltage applied by the second driver circuit has a second polarity, wherein the first and second polarities creates currents though the first and second inductors such that the currents have a relative polarity that results in a positive mutual inductance between the conductor signal paths of the first and second broadside coupled coplanar inductors that adds to a self inductance of each of the conductor signal paths of the first and second inductors.

15. The broadside coupled coplanar inductor device of claim 14, wherein the first and second voltages of the first and second driving circuits are substantially the same.

16. The broadside coupled coplanar inductor device of claim 15, wherein the currents in the first and second inductors are substantially equal.

* * * * *